US008844183B2

(12) United States Patent
Sullivan

(10) Patent No.: US 8,844,183 B2
(45) **Date of Patent: *Sep. 30, 2014**

(54) HIGH CAPACITY MAGAZINE

(71) Applicant: ArmWest, LLC, Prescott, AZ (US)

(72) Inventor: Leroy James Sullivan, Prescott, AZ (US)

(73) Assignee: ArmWest, LLC, Prescott, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/071,489

(22) Filed: Nov. 4, 2013

(65) Prior Publication Data

US 2014/0053446 A1 Feb. 27, 2014

Related U.S. Application Data

(63) Continuation of application No. 13/071,913, filed on Mar. 25, 2011, now Pat. No. 8,572,877.

(60) Provisional application No. 61/317,386, filed on Mar. 25, 2010.

(51) Int. Cl.

| | |
|---|---|
| ***F41A 9/61*** | (2006.01) |
| ***F41A 9/69*** | (2006.01) |
| ***F41A 9/70*** | (2006.01) |

(52) U.S. Cl.

CPC .... *F41A 9/69* (2013.01); *F41A 9/70* (2013.01)
USPC ..... 42/50; 42/18

(58) Field of Classification Search

CPC ..... F41A 9/69; F41A 9/61; F41A 9/65
USPC ..... 42/50, 18
See application file for complete search history.

(56) References Cited

U.S. PATENT DOCUMENTS 1,202,707 A 10/1916 Greico
2,217,848 A * 10/1940 Schillstrom ..... 42/50

(Continued)

FOREIGN PATENT DOCUMENTS

CN 2534547 Y 2/2003
DE 569280 2/1933

(Continued)

OTHER PUBLICATIONS

Anonymous: "Magazine Feed Liptool," Internet Article, http://www.brownells.com/.aspx/pid=25049/Product/Magazine-Feed-Liptool, Retrieved from the Internet on Jul. 3, 2012.

*Primary Examiner* — Michelle Clement
(74) *Attorney, Agent, or Firm* — Haynes and Boone, LLP

(57) ABSTRACT

A box magazine for a firearm may have a housing with two substantially different widths. A wider region may accommodate four columns of cartridges and may have tapered surfaces at one end that lead into a narrower region which may accommodate an interlocked and staggered double column of cartridges. Cartridges in the wider region may be separated into two staggered double columns by a free standing dividing wall and may be advanced by inner and outer contoured followers that may be nested together to form a single follower assembly surrounding the freestanding wall and that may be driven by the outer follower's spring. An inner follower spring may remain nested within the outer follower such that the two followers coordinate the advance of the two separated double columns of cartridges toward tapered surfaces that merge the two double columns into two single columns proximate the top of the dividing wall.

28 Claims, 6 Drawing Sheets

(56) References Cited

U.S. PATENT DOCUMENTS

| | | | | | |
|---|---|---|---|---|---|
| 3,226,869 | A | | 1/1966 | Musgrave | |
| 3,345,771 | A | * | 10/1967 | Silsby | 42/18 |
| 3,440,751 | A | | 4/1969 | Fremont | |
| 3,604,142 | A | * | 9/1971 | Silsby | 42/50 |
| 4,428,137 | A | | 1/1984 | Johnson | |
| 4,446,645 | A | | 5/1984 | Kelsey, Jr. | |
| 4,524,672 | A | | 6/1985 | Balsavage | |
| 4,589,218 | A | | 5/1986 | Teppa | |
| 5,168,648 | A | | 12/1992 | Brandl | |
| 6,898,888 | B2 | | 5/2005 | Greenhut | |
| 7,117,626 | B1 | | 10/2006 | Alzamora | |
| 2003/0188567 | A1 | | 10/2003 | Garrett | |
| 2010/0126053 | A1 | | 5/2010 | Fitzpatrick | |
| 2012/0131831 | A1 | * | 5/2012 | Sullivan et al. | 42/50 |

FOREIGN PATENT DOCUMENTS

| | | |
|---|---|---|
| DE | 203574 | 8/1938 |
| DE | 664926 | 9/1938 |
| DE | 712084 | 10/1941 |
| DE | 858944 | 12/1952 |
| DE | 102006011278 | 9/2007 |
| DE | 102007011502 | 9/2008 |
| GB | 536728 | 5/1941 |
| GB | 1227706 | 4/1971 |
| WO | WO 97/25581 | 7/1997 |

* cited by examiner

HIGH CAPACITY MAGAZINE

CROSS-REFERENCE TO RELATED APPLICATIONS

This application is a continuation application of U.S. patent application Ser. No. 13/071,913 filed Mar. 25, 2011 and entitled "HIGH CAPACITY MAGAZINE", which claims the benefit of U.S. Provisional Patent Application No. 61/317,386 filed Mar. 25, 2010 and entitled "HIGH CAPACITY MAGAZINE", all of which are hereby incorporated by reference in their entirety.

BACKGROUND

1. Technical Field

The present disclosure relates generally to firearms and relates more particularly to high capacity box magazines for feeding cartridges to firearms.

2. Related Art

Removable magazines for feeding cartridges to firearms are well known. There are generally two main types of magazines, i.e., box magazines and drum magazines. Box magazines are generally limited to about 30 cartridges, so as to maintain reliability. Drum magazines typically hold 50-150 cartridges. Because of their lower capacity, box magazines must generally be changed more often than drum magazines. Box magazines are much lighter, simpler, and more compact. A person may carry more cartridges loaded in box magazines than drum magazines. Drum magazines are generally preferred over box magazines for high capacity applications.

It is desirable to provide magazines having high capacities. The use of magazines having high capacities requires less frequent magazine changes than the use of magazines having low capacities. The use of high capacity magazines better assures that the firearm will be ready to use when needed.

Because of their higher capacities, drum magazines require less frequent magazine changes as compared to box magazines, but drum magazines are much heavier, more complicated, and are comparatively bulky. Although drum magazines initially provide greater firepower, their weight and bulk reduce the amount of ammunition (held in magazines) that a person may carry. One option is for a person to carry a drum magazine (such as a 100-shot drum magazine) on the firearm for initial firepower and to carry the rest of the ammunition in box magazines (such as 30 round box magazines). However, such an approach is often impractical due to the bulk of the drum magazine and due to the number of box magazines required, for example.

It is desirable to combine the large capacity of a drum magazine with the light compact size and portability of a box magazine, so as to obtain both the greater initial fire power of the drum magazine and the greater sustained firepower of a plurality of box magazines. However, as the size of a magazine is increased to accommodate more cartridges, a longer, higher force spring must generally be used to move the cartridges within the magazine. As the capacity of a magazine is increased, each added cartridge tends to reduce the reliability of the magazine. For example, the higher force provided by the higher force spring, particularly when fully compressed, may cause undesirable feed problems that render the firearm temporarily inoperable.

According to conventional methodology, increasing the capacity of a conventional double column box magazine from the 30 cartridges common today to 100 cartridges would undesirably more than triple the length of the magazine and would also require three and one third times the force to accelerate the three and one third times the weight of cartridges in order to lift the top cartridge up into the feed path of the firearm as fast as is accomplished when using a conventional 30 cartridge magazine (such as a 30 cartridge magazine for which most automatic firearms are commonly designed). Such conventional firearms would often be unable to strip the top cartridge forward out of the magazine and into the chamber if the output force lifting and holding the top cartridge in a feed position were increased three and one third fold. The use of such force would often thus undesirably interfere with the automatic firearm cycle.

U.S. Pat. No. 2,217,848 discloses a four column magazine having a dividing wall that passes completely through the fore and aft interior space of the magazine (thus vertically dividing the magazine in two). Such a magazine uses two separate followers and springs so that each follower and spring must separately advance their respective two sets of cartridges with no positive connection between the two followers to synchronize their motion. Such separate, non-synchronized movement of the two sets of cartridges may result in the undesirable jamming of the magazine.

U.S. Pat. No. 4,589,218 discloses a four column magazine that has a fore and aft dividing wall and uses a single follower to advance all four columns, including advancing the last round, to the feed position. However, a single follower that will advance all four columns of cartridges cannot readily be made to continue upwardly through a double column portion of a magazine. Such double column magazines or portions of magazines are required so as to fit the magazine well of a firearm within the M4/M16 family of weapons, whose interface dimensions for the magazine fit have been recommended as a NATO standard.

In view of the foregoing, it would be beneficial to provide an improved box magazine, such as a box magazine that has increased capacity and/or enhanced reliability with respect to contemporary magazines.

SUMMARY

According to an embodiment, a high capacity box magazine is provided. The high capacity box magazine typically requires less frequent magazine changes than conventional lower capacity box magazines. Nested followers and nested springs may facilitate the advancement of cartridges within the box magazine to a firearm in a manner that substantially maintains the reliability of a conventional lower capacity box magazine without requiring significantly greater length in order to accommodate the increased capacity.

According to an embodiment, a magazine may comprise two followers and two springs that are adapted to move the followers. The followers and the springs may be adapted to facilitate merging of substantially four columns of cartridges into substantially two interlocked and staggered columns of the cartridges, such that movement of the cartridges is accelerated and such that a force applied by the cartridges that inhibits stripping is reduced, as discussed herein.

According to an embodiment, a magazine may comprise a housing adapted to facilitate merging of substantially four columns of cartridges into substantially two interlocked and staggered columns of the cartridges. Movement of the cartridges may be accelerated such that a force applied by the cartridges that inhibits stripping is reduced.

According to an embodiment, a magazine may comprise two followers adapted to nest at least partially one within the other. The two followers may cooperate to define a single follower assembly that functions as a single follower. The two followers may separate such that one of the two followers continues to function as a follower after separation.

According to an embodiment, a magazine may comprise two springs adapted to nest at least partially one within the other. At some times, the two springs may be partially nested or completely nested with respect to one another. At other times, the two springs may be substantially or completely un-nested and extended with respect to one another.

According to an embodiment, a magazine may comprise a housing and a dividing wall having a bottom. The dividing wall may separate cartridges into two sets thereof. The dividing wall may be held to the housing only at the bottom of the dividing wall. For example, the dividing wall may be held to the bottom of the housing by the force of a spring.

According to an embodiment, a magazine may comprise a housing adapted to mate to a substantially two column magazine well of a firearm. The housing may be adapted to contain substantially four columns of cartridges.

According to an embodiment, a housing for a magazine may comprise a plurality of walls converging in the area between the substantially four column and the substantially two column widths of the housing to squeeze the upward path of the substantially four columns of cartridges into substantially two columns of cartridges, thus approximately doubling the upward speed of the substantially two columns of cartridges and reducing the upward applied force thereof by approximately half compared to the upward speed and applied force of the substantially four columns. In this manner, movement of the cartridges may be accelerated and a force applied by the cartridges that inhibits stripping may be reduced.

According to an embodiment, an outer follower for a magazine may comprise a plurality of surfaces adapted to support a plurality of cartridges. The outer follower may be adapted to move within a magazine housing and the outer follower being adapted to nest with an inner follower.

According to an embodiment, an inner follower for a magazine may comprise a plurality of surfaces adapted to support a plurality of cartridges. The inner follower may be adapted to move within a magazine housing and the inner follower may be adapted to nest with an outer follower.

According to an embodiment, a follower assembly for a magazine may comprise an outer follower adapted to move within a magazine housing and an inner follower adapted to move within the magazine housing. The inner follower may be adapted to nest at least partially within the outer follower.

According to an embodiment, a magazine may comprise first supporting means for supporting a plurality of cartridges, second supporting means for supporting a plurality of cartridges, first moving means for moving the first supporting means, second moving means for moving the second supporting means, and means for separating cartridges into two sets. The first supporting means and the second supporting means may be adapted to nest at least partially together.

According to an embodiment, a method for advancing cartridges within a magazine may comprise merging substantially four columns of cartridges into substantially two interlocked and staggered columns of the cartridges. Movement of the cartridges may be accelerated and a force applied by the cartridges that inhibits stripping may be reduced.

According to an embodiment, a method for advancing cartridges within a magazine may comprise moving substantially four columns of cartridges within a portion of the magazine using two nested followers. Substantially two columns of cartridges may be moved within a different portion of the magazine using an inner one of the two nested followers.

According to an embodiment, a method for advancing cartridges within a magazine may comprise nesting one follower at least partially within another follower. The followers may be at least partially nested at some times and may be not nested at other times.

According to an embodiment, a method for advancing cartridges within a magazine may comprise nesting one spring at least partially within another spring. The springs may be at least partially nested at some times. The springs may be more nested at some times and less nested at other times.

According to an embodiment, a method for advancing cartridges within a magazine may comprise separating cartridges in a housing into two sets thereof. For example, a dividing wall may be used to facilitate such separation. The dividing wall may be held to the housing only at the bottom of the dividing wall.

According to an embodiment, a method of making a magazine may comprise forming a housing that is adapted to facilitate merging of substantially four columns of cartridges into substantially two interlocked and staggered columns of cartridges. In this manner, movement of the cartridges may be accelerated and a force applied by the cartridges that inhibits stripping may be reduced.

According to an embodiment, a method of making a magazine may comprise putting two followers into a housing. The two followers may be adapted to nest at least partially one within the other.

According to an embodiment, a method of making a magazine may comprise putting two springs into a housing. The two springs may be adapted to nest at least partially one within the other.

According to an embodiment, a method of making a magazine may comprise attaching a dividing wall within a housing only at a bottom of the dividing wall. Thus, the dividing wall may be substantially free standing within the housing. The dividing wall may be adapted to separate cartridges within the housing into two sets thereof.

According to an embodiment, a method for using a magazine may comprise mating a magazine to a firearm. The magazine may be adapted to merge substantially four columns of cartridges into substantially two interlocked and staggered columns of cartridges such that movement of the cartridges is accelerated and such that a force applied by the cartridges that inhibits stripping is reduced.

According to an embodiment, a method for using a magazine may comprise mating a magazine to a firearm. The magazine may be adapted to nest one follower at least partially within another follower and/or the magazine may be adapted to nest one spring at least partially within another spring.

According to an embodiment, a method for using a magazine may comprise mating a magazine to a firearm. The magazine may be adapted to separate cartridges into two sets thereof using a dividing wall that is held to a housing of the magazine only at a bottom of the dividing wall.

According to an embodiment, a magazine for providing cartridges to a firearm may comprise a housing having a top end and a bottom end that is substantially opposite the top end. An outer follower may be movably disposed within the housing. An inner follower may also be movably disposed within the housing. The inner follower may be adapted to nest at least partially within the outer follower. A first spring may be disposed within the housing and may be adapted to move the outer follower away from the bottom end of the housing. A second spring may be disposed within the housing and may be adapted to move the inner follower away from the outer follower and toward the top end of the housing. The second spring may be adapted to nest at least partially within the outer follower. The first spring and the second spring may be adapted to expand to move the cartridges to the firearm.

According to an embodiment, a method for providing cartridges to a firearm using a magazine may comprise moving the cartridges away from a bottom end of a housing of a magazine and toward a top end of the housing that is substantially opposite the bottom end using a first spring disposed in the housing and an outer follower disposed in the housing. The cartridges may be moved away from the outer follower and toward the top end of the housing using a second spring disposed in the housing and an inner follower disposed in the housing. The inner follower may be adapted to nest at least partially within the outer follower. The second spring may be adapted to nest at least partially within the outer follower.

According to an embodiment, a weapon system may comprise a firearm and a magazine for providing cartridges to the firearm. The magazine may be removably attachable to the firearm. The magazine may comprise a housing having a top end and a bottom end substantially opposite the top end. An outer follower may be movably disposed within the housing. An inner follower may be movably disposed within the housing and adapted to nest at least partially within the outer follower. A first spring may be disposed within the housing and may be adapted to move the outer follower away from the bottom end of the housing. A second spring may be disposed within the housing and may be adapted to move the inner follower away from the outer follower and toward the top end of the housing. The second spring may be adapted to nest at least partially within the outer follower. The first spring and the second spring may be adapted to expand to move the cartridges to the firearm.

The scope of the disclosure is defined by the claims, which are incorporated into this section by reference. A more complete understanding of embodiments of the present disclosure will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the present disclosure and their advantages are best understood by referring to the detailed description that follows. It should be appreciated that like reference numerals are used to identify like elements illustrated in one or more of the figures.

DETAILED DESCRIPTION

Figure 1:
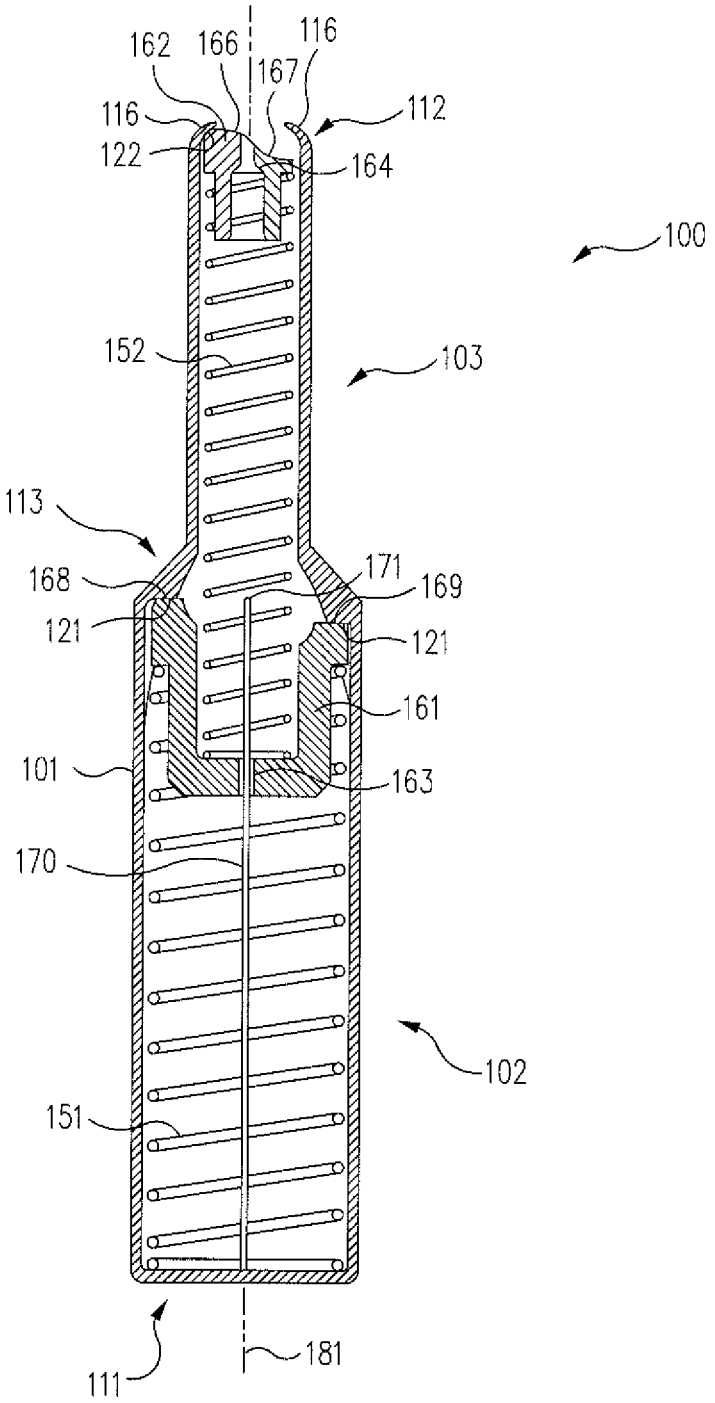
FIG. 1 is a cross-sectional view of a high capacity magazine that has no cartridges held therein, in accordance with an embodiment of the disclosure.

Examples of embodiments of high capacity magazines are disclosed herein. One or more embodiments use four or more columns of cartridges that are transitioned into fewer columns (such as two columns, for example). This is done in a manner that controls the cartridges as they are transitioned into fewer columns so that each of the cartridges reliably meshes and coordinates with others of the cartridges.

Such embodiments generally require less frequent magazine changes than conventional lower capacity magazines. Higher capacities may be provided without sacrificing reliability, such as due to the use of nested followers and nested springs as disclosed herein. Thus, a more effective weapon system may be provided for use in battlefield, police, and other situations.

In an embodiment, a high capacity magazine may be implemented with a four column width that reduces the overall length (e.g., long dimension) of the magazine. Since the NATO countries have all agreed to use the same staggered double column magazine that their firearms are made to fit, an upper region of the high capacity magazine may use a staggered double column configuration to fit the now standard NATO rifle magazine well. Thus, in such an embodiment the length reduction of the magazine may be limited to that amount that is facilitated by the increased capacity that is contributed by the four column section of the magazine.

In an embodiment, the greater width of the four columns increases the potential width of the spring coils used to force cartridges upward in the magazine. This allows the springs to be adapted in a full circle coil instead of the conventional elongated, e.g., rectangular, coil configuration that is used in conventional two column width magazines. Such conventional elongated coil springs are so highly stressed even in 30 shot magazines it is common practice to load only 28 cartridges to ensure that the spring does not set and consequently fail to correctly feed the last cartridge or cartridges. Advantageously, round coils have less stress per load than any other coil shape because they are equally stressed throughout the length of the wire and thus tend to lack the concentrated high stress points of conventional elongated coil springs.

Concentric round coils of different diameters may be made to telescope or nest within one another to reduce the compressed stack height of the spring coils and the resulting magazine height. A free standing dividing wall may then fit in the center of such a spring group without interfering or limiting the space available for the coil springs. The dividing wall may effectively define a spring guide so as to limit undesirable movement of the springs, such as lateral movement thereof. The dividing wall may also divide the cartridges into two sets thereof and may help position the cartridges for proper merging of the two sets.

A transition or tapered portion of the magazine between the four column region and the two column region thereof may accelerate the cartridges as they move so as to substantially reduce the output force on the top cartridge while increasing the input force needed to advance three and one third times the weight (for example, the weight of 100 cartridges according to an embodiment versus the weight of 30 cartridges for a conventional magazine) the equivalent distance in the same time as in the conventional 30 shot magazine. This may be done while still stopping and restarting cartridge movement during each gun firing cycle.

This acceleration is the result of a principle analogous to the relationship of force, area, and speed in hydraulics. The four columns of cartridges act like a larger piston driving the smaller double column of cartridges. The double column of cartridges is thus driven at twice the speed with one half of the output force.

The result is that only about one half of the otherwise three and one third times greater force is needed in such an embodiment to lift the top cartridge in the desired amount of time (the portion of the automatic cycle between when the bolt's rearward motion uncovers the top cartridge then reverses motion and starts to drive the cartridge forward). Because of this acceleration, only about one half of the force that would otherwise be transferred to and applied by the uppermost cartridge to the top (lips) of the magazine is actually applied. Thus, instead of the output force of the 100 cartridge magazine being 333% of the output force of a conventional 30 cartridge magazine, the output force is only about 83% thereof (4 to 1 gain). In this manner, the stripping force is substantially and desirably reduced as compared to that of a conventional 30 cartridge magazine.

As those skilled in the art will appreciate, the stripping force of a spring driven automatic firearm is the force that the bolt must apply to the uppermost cartridge of a magazine in order to drive (strip) the cartridge forward out of the magazine and into the chamber of the barrel of the firearm. Excessive stripping resistance (which opposes stripping force) may cause an interrupted feed or jam (e.g., misfeed), wherein the firearm cannot be used until the misfeed is corrected. Such a misfeed may result in a soldier or police officer being endangered and possibly killed. Therefore, it is important to maintain the stripping resistance well below that which the firearm was designed to accommodate.

In order to reliably control and coordinate the meshing of the cartridges transitioning from four columns into two columns, it is important to maintain the pattern and relative position of every cartridge on one side of the dividing wall with respect to those cartridges on the opposite side of the dividing wall that they will eventually mesh with. For example, if one set (on one side of the dividing wall) of the cartridges were to move slower than the other set of cartridges (on the other side of the dividing wall), then the cartridge that reaches the double column section first may cross over into the empty space of the delayed cartridge and the magazine could become jammed.

In an embodiment, to ensure that the cartridge motion on both sides of the dividing wall stays synchronized, a four column follower assembly may be adapted as one piece that surrounds the dividing wall, as do the springs, so that everything advances together or else does not advance at all. In such an embodiment, the four column follower assembly may be adapted as one piece by nesting two followers, which then combine or cooperate to define a one piece follower assembly.

As discussed above, U.S. Pat. No. 2,217,848 discloses a four column magazine having a dividing wall that passes completely through the fore and aft interior space of the magazine (thus vertically dividing the magazine substantially in two). Such a magazine uses two separate followers and springs so that each follower and spring must separately advance their respective two sets of cartridges with no positive connection between the two to synchronize motion. As discussed above, such separate, non-synchronized movement of the two sets of cartridges may result in undesirable jamming of the magazine.

By way of contrast with respect to U.S. Pat. No. 2,217,848 and according to an embodiment, the two followers disclosed herein are nested in a manner that provides a positive connection therebetween at least during a portion of their travel within the magazine housing, as described in detail herein. Such positive connection facilitates the synchronization of the two sets of cartridges so as to substantially mitigate the likelihood of the magazine jamming.

As discussed above, U.S. Pat. No. 4,589,218 discloses a four column magazine that has a fore and aft dividing wall and uses a single follower to advance all four columns including advancing the last round to the feed position. A single follower that will advance all four columns of cartridges cannot readily be made to continue upwardly through a double column magazine, which is the required configuration to fit the magazine well of a firearm within the M4/M16 family of weapons.

By way of contrast with respect to U.S. Pat. No. 4,589,218 and according to an embodiment, the follower assembly disclosed herein may comprise nested followers such that the combined followers cooperate to advance all four columns in the four column region of the magazine and such that one of the followers may separately continue upward through a two column region of the magazine as required to fit the magazine well of a firearm within the M4/M16 family of weapons.

According to an embodiment, a box magazine for a firearm has a housing with two substantially different widths. The wider lower region (which defines the four column region) may accommodate four columns of cartridges thereacross. A transition defined by converging or tapered surfaces at one end (e.g., an upper end) of the lower region may lead into a narrower upper region (which defines the two column region) which may accommodate an interlocked staggered double column of cartridges. Cartridges in the lower region may be separated into two staggered double columns by a free standing dividing wall and may be advanced by an inner contoured follower and outer contoured follower that are at least partially nested together to form a single follower assembly surrounding the freestanding wall and driven by the outer follower's spring.

An inner follower spring that is weaker than the outer follower spring may remain telescoped in, i.e., substantially compressed, and inoperable within the outer follower to facilitate the definition of combined contoured steps of the two followers. The contoured steps support the cartridges at somewhat staggered positions that facilitate their merging at the transition. The two followers cooperate to coordinate the advance of the two separated double columns of cartridges toward the tapered surfaces that guide and transition, i.e., merge, the two double columns into a staggered interlocked double column just above the top most end of the dividing wall. Thus, the two staggered double columns form one staggered double column as they enter the narrower upper region of the housing.

As the last of the cartridges are advanced out of the wider lower region, the motion of the outer follower is arrested by stops. That relieves the inner spring of the greater force of the outer spring which had held it inoperable and acts to release the inner follower which is thereafter driven independently by the inner spring so as to advance the remaining double column of cartridges through the narrower upper region of the housing.

Thus, according to an embodiment, the same configuration that is used to increase the capacity of the magazine helps to mitigate feed problems. That is, the use of four columns that merge into two columns reduces the stripping force required such that problems caused by the firearm having insufficient stripping force are substantially mitigated. This is made possible by using a follower assembly wherein a portion thereof (one of two followers thereof) may pass through the narrower two column region of the magazine to facilitate the advancement of cartridges within the magazine.

A tapered portion may define a transition between the four column region of the magazine and the two column region thereof. The transition may disassociate at least some of the behavior of the four column region and the two column region with respect to one another. Thus, the number of columns, the force provided by the cartridges, and the speed at which the cartridges move may be different in each region.

Moreover, the two column region of the magazine may function in a manner that is generally similar to a straight 16-shot M16 magazine (which is superior to the original 20-shot M16 magazine). The four column region may have all of the benefits of a fully curved magazine that is relieved of the need to compensate for the angular error imposed on tapered cartridges by the straight two column region. The lower four column region may thus have any desired capacity up to the point where the increased spring force (to accelerate the increased ammunition weight) becomes so strong that this force begins to retard the gun's firing cycle in an undesirable manner.

In addition to facilitating a doubling of the speed of the top cartridges while cutting the spring force in half, the transition also compensates, at least to some degree, for the angular error imposed by the straight two column region. Unlike the cartridges in the straight two column region and the cartridges in the curved four column region (both of which are substantially trapped within staggered double columns and thus cannot tilt without tilting their neighbors), the cartridges in the transition may crisscross and tilt independently with respect to one another.

The walls of the transition may squeeze the four columns into two columns in a manner that allows the cartridges to crisscross with one another. As the cartridges rise within the transition, they position themselves for entry into the two column region. The top cartridge thus remains square with respect to the feed throat of the magazine and does not obtain an undesirable nose down or base down orientation or attitude. In this manner, nose dives, overrides, and other misfeed/jam problems are substantially mitigated. This configuration also enhances uniformity of feeding (all of the cartridges tend to feed with substantially the same orientation or attitude).

Examples of embodiments are discussed below with reference to the figures. As those skilled in the art will appreciate, other embodiments, which may use other features or combinations of features, may likewise fall within the scope of the claims.

Referring now to FIGS. 1-9, examples of embodiments of the disclosure are discussed. In the following discussion and figures, like numbers refer to like structures.

FIG. 1 illustrates a high capacity magazine 100 that has no cartridges held therein, in accordance with an embodiment of the disclosure. The magazine 100 may be adapted to hold 50 cartridges 310, for example. The magazine 100 may be adapted to be removably attached to a firearm. For example, the magazine 100 may be adapted to removably attach to a firearm belonging to the M4/M16 family of weapons. The magazine 100 may be adapted to removably attach to any desired firearm.

In an embodiment, the magazine 100 may attach to the firearm via a latch, such as in the manner that a conventional magazine attaches to an M-16 rifle. In other embodiments, the magazine 100 may attach in any desired manner.

Figure 2:
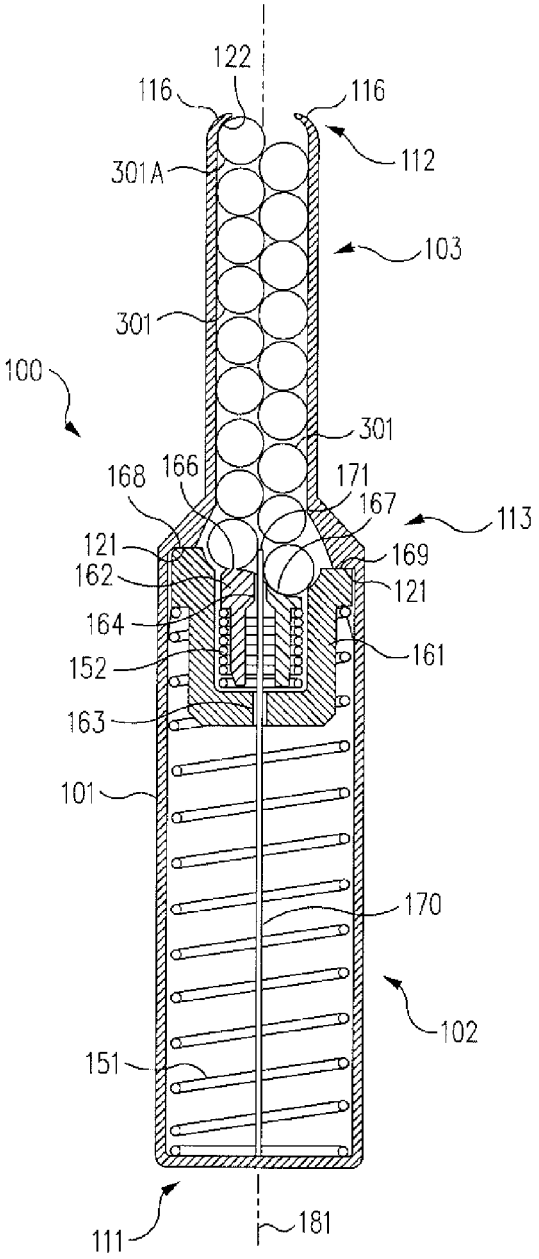
FIG. 2 is a cross-sectional view of a high capacity magazine that is partially filled with cartridges, in accordance with an embodiment of the disclosure.
Figure 3:
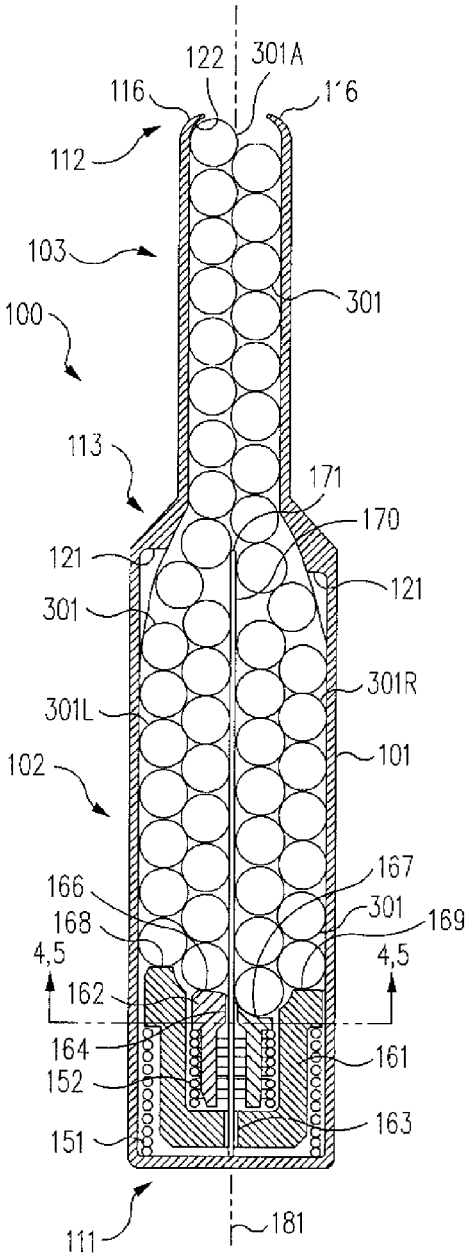
FIG. 3 is a cross-sectional view of a high capacity magazine that is substantially filled with cartridges, in accordance with an embodiment of the disclosure.
Figure 5:
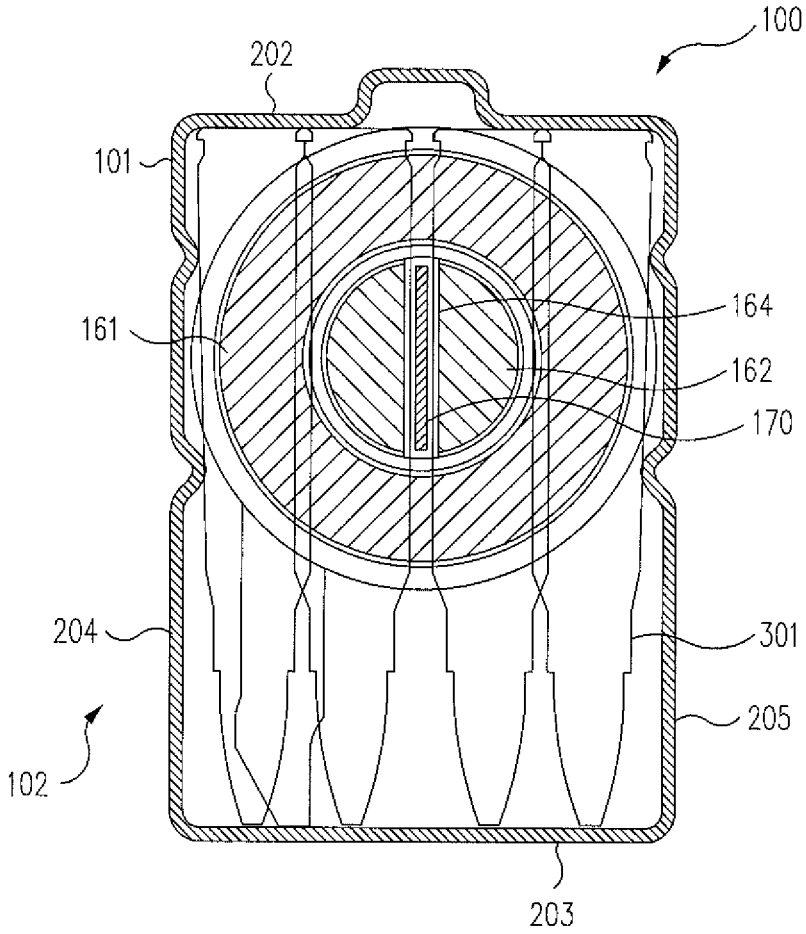
FIG. 5 is a cross-sectional view taken along line 4,5 of FIG. 3 with four cartridges superimposed thereon, in accordance with an embodiment of the disclosure.

The magazine 100 may comprise a housing 101 within which cartridges 301 are loaded (as shown in FIGS. 2, 3, and 5). The cartridges 301 disposed within housing 101 may be fed from the magazine 100 into the firearm, as discussed in detail herein. The housing 101 may be adapted to hold a larger number of the cartridges 301 as compared to typical conventional magazines, particularly conventional magazines of approximately the same length.

Although the housing 101 is adapted to hold 50 of the cartridges 301 as illustrated and discussed herein, this is by way of example only and not by way of limitation. For example, the housing 101 may be adapted to hold 30, 50, 100, 150, or more of the cartridges 301. Indeed, the housing 101 may be adapted to hold any desired number of the cartridges 301.

The housing 101 may be adapted to hold any desired type of the cartridges 301. For example, the housing 101 may be adapted to hold any desired caliber of rifle or pistol cartridges. More particularly, the housing 101 may be adapted to hold cartridges such as 0.223, 5.56×45 NATO, 7.62×39 mm, or 7.62×51 NATO, for example.

A lower region 102 of the housing 101 may be adapted to hold the cartridges 301 in a generally four across configuration (as shown in FIGS. 3 and 5). An upper region 103 of the housing 101 may be adapted to hold the cartridges 301 in a generally two across configuration (as shown in FIGS. 2 and 3). Thus, the lower region 102 of the housing 101 may be substantially wider than the upper region 103 of the housing 101.

In the four across configuration and/or in the two across configuration, the cartridges 301 may be substantially staggered, such that the cartridges 301 are not all at the same height or distance from a bottom 111 of the magazine (as shown in FIG. 3).

Although housing 101 may be adapted to hold the cartridges 301 substantially four across in the lower region 102 thereof and substantially two across in the upper region 103 thereof as illustrated and discussed herein, this is by way of example only and not by way of limitation. Any desired number of regions, holding any desired number of the cartridges 301 thereacross, may be used.

A tapered portion 113 may connect the lower region 102 of the housing 101 to the upper region 103 of the housing 101. The tapered portion 113 may be formed into the housing 101. The upper region 103 of the housing 101 may be adapted to be received within a magazine well of a firearm and the lower region 102 may be adapted to extend outwardly (e.g., downwardly), away from the firearm.

The housing 101 may comprise the bottom end 111 and a top end 112. The lips 116 may be formed at the top end 112 of the housing 101. The lips 116 may be adapted to keep the cartridges 301 held within the housing 101 until the cartridges 301 are fed from the magazine 100, such as by action of the firearm's bolt (not shown) during cocking or shooting of the firearm. The lips 116 also define one or more inner follower stops 122 that limit movement of an inner follower 162 away from the bottom end 111 of the housing 101.

The tapered portion 113 may define one or more outer follower stops 121. The outer follower stops 121 may limit movement of an outer follower 161 away from the bottom end 111 of the housing 101.

According to an embodiment, the housing 101 may be made of metal, composite, or plastic. For example, the housing 101 may be made of sheet metal. As a further example, the housing 101 may be made of any desired combination of aluminum, steel, and/or titanium. Any other suitable material or combination of materials may similarly be used. The housing 101 may be made by forming, e.g., bending and stretching, modeling and/or by machining, e.g., milling. The housing 101 may be made by any desired method.

Inside of the housing 101 may be contained a mechanism for advancing the cartridges 301 upwardly, toward the top end 112 of the housing 101. This mechanism may comprise a outer spring 151, a inner spring 152, the outer follower 161, the inner follower 162, and a dividing wall 170.

The housing 101 may substantially define an enclosure for the magazine 100. In an embodiment, substantially all of the components of the magazine 100, as well as any of the cartridges 301 held therein, are disposed within the housing 101. In another embodiment, the housing 101 may be more frame-like. For example, the housing 101 may have openings such that it does not completely enclose all of the components of the magazine 100 and/or all of the cartridges 301 held therein. In another embodiment, portions or entire components of the magazine 100 may be disposed outside of the housing 101. Accordingly, the housing 101 may have any desired configuration.

The outer spring 151 may be disposed substantially between the outer follower 161 and the bottom end 111 of the housing 101. The outer follower 161 may be disposed substantially between the outer spring 151 and the inner spring 152. The inner spring 152 may be disposed substantially between the outer follower 161 and the inner follower 162. The inner follower 162 may be disposed substantially between the inner spring 152 and the top end 112 of the housing 101.

In an embodiment, the dividing wall 170 may extend upwardly from the bottom end 111 of the housing 101 and may be held to the housing 101 only at the bottom end 111 of the housing 101. Thus, the dividing wall 170 may be adapted such that it is not supported along the length thereof or at the top end thereof and is freestanding flexible and self centering. The dividing wall 170 may be supported and centered by the cartridges 301 on either side thereof when the magazine is at least partially filled with the cartridges 301.

The dividing wall 170 may extend through the outer spring 151, the outer follower 161, at least a portion of the inner spring 152, and the inner follower 162 (when the inner follower 162 is in the lower region 102 of the magazine 100). The dividing wall 170 may extend through a portion of the inner spring 152 when the inner spring 152 is fully expanded (as shown in FIG. 1) and the dividing wall 170 may extend through the entire inner spring 152 when the inner spring 152 is completely compressed (as shown in FIGS. 2 and 3).

The dividing wall 170 may extend substantially along a central, i.e., longitudinal, axis 181 of magazine 100. The longitudinal axis 181 may be a central axis of the outer spring 151, the inner spring 152, the outer follower 161, and the inner follower 162.

The outer follower 161 and the inner follower 162 may move or slide within the housing 101 and along the dividing wall 170. An opening 163 of the outer follower 161 and an opening 164 of the inner follower 162 may facilitate such movement of the outer follower 161 and the inner follower 162 with respect to the dividing wall 170. The opening 163 of the outer follower 161 and the opening 164 of the inner follower 162 may receive and loosely position the dividing wall 170 and align a tip 171 of the dividing wall 170 to divide the substantially two columns of cartridges 301 into two separate sets thereof when the cartridges 301 are being loaded into the magazine 100. The cartridges then center the flexible free standing dividing wall.

FIG. 2 is a cross-sectional view of the magazine 100 that is partially filled with the cartridges 301, in accordance with an embodiment of the disclosure. As shown, the upper region 103 and the transition defined by the taper 113 hold the cartridges 301. As shown, the lower region 102 does not hold the cartridges 301. For example, magazine 100 may be filled in this manner when it has been partially loaded or has previous been fully loaded and some of the cartridges 301 have been fired.

As may be seen, the outer spring 151 is fully expanded and the inner spring 152 is fully compressed. During shooting, this configuration results after all of the cartridges 301 have been emptied from the lower region 102 of the housing 101 and the upper region 103 is still filled with the cartridges 301 (at least some of which had previously been in the lower region 102). In this configuration, the outer follower 161 has ceased upward movement and the inner follower 162 may now continue to move the cartridges 301 toward the top end 112 of the housing 101.

More particularly, the outer follower 161 has ceased upward movement because staggered upper surfaces 168 and 169 thereof have contacted the outer follower stops 121. The inner follower 162 is still free to move upwardly, toward the top end 112 of the housing 101.

The outer spring 151 may be substantially stronger than the inner spring 152. Therefore, the inner spring 152 may remain fully compressed until upward movement of the outer follower 161 is halted by outer follower stops 121. After upward movement of the outer follower 161 has been halted, then the inner spring 152 may be free to expand so as to continue to move the cartridges 301 toward the top end 112 of the housing 101 and thus feed the cartridges 301 to the firearm.

Figure 4:
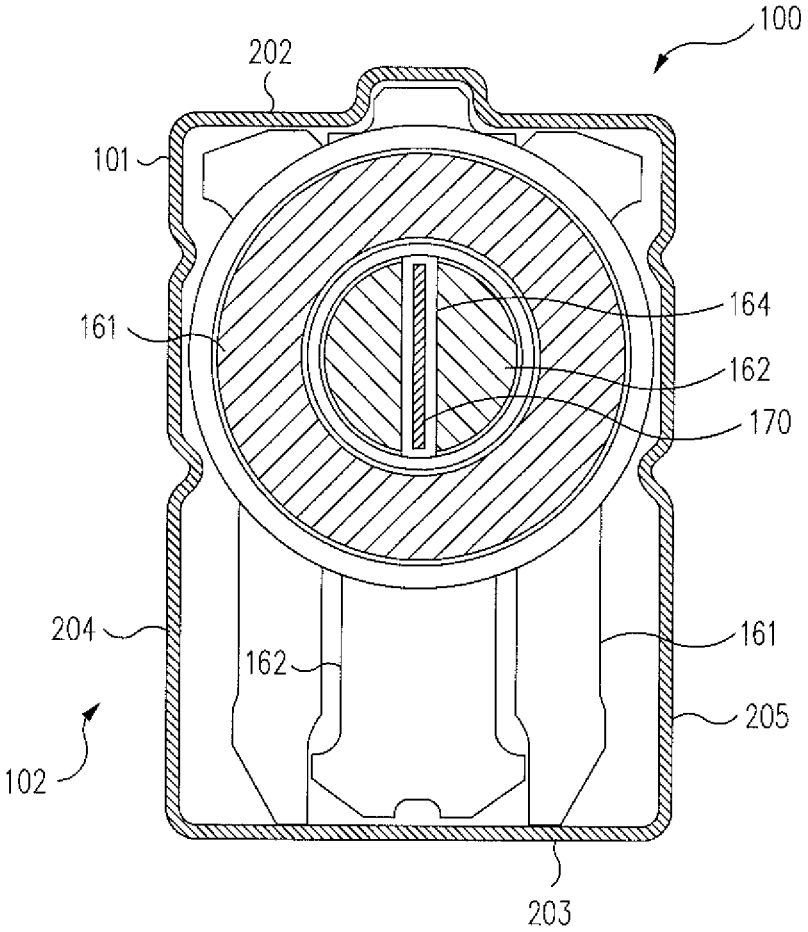
FIG. 4 is a cross-sectional view taken along line 4,5 of FIG. 3, in accordance with an embodiment of the disclosure.

FIGS. 3-5 are cross-sectional views of the magazine 100 when the magazine 100 is substantially filled (such as completely filled) with cartridges 301, in accordance with an embodiment of the disclosure. FIGS. 4 and 5 are cross-sections taken along line 4, 5 of FIG. 3. No cartridges 301 are shown in FIG. 4. Cartridges 301 are shown in FIG. 5. In FIGS. 3 and 5, the magazine 100 is filled with cartridges 301 such that the outer spring 151 and the inner spring 152 are substantially (approximately fully) compressed.

As may be seen, the dividing wall 170 separates the cartridges 301 into two sets. One set is to the left of the dividing wall 170 and one set is to the right of the dividing wall 170.

With particular reference to FIGS. 4 and 5, the housing 101 may comprise a rear wall 202, a front wall 203, and two side walls 204 and 205. Those skilled in the art will appreciate that various other configurations of the housing 101 are likewise suitable.

The cartridges 301 from the two sets may merge in the transition defined by the tapered portion 113 after passing by the tip 171 (e.g., upper end) of the dividing wall 170. Thus, the cartridges 301 from the lower region 102 may move to the upper region 103 as the cartridges 301 from a four across cartridge configuration merge of the magazine 100 to form a two across cartridge configuration of the magazine 100.

Moreover, the cartridges 301 on one side of the dividing wall 170 may move along with the cartridges 301 on the other side of the dividing wall 170 such that both sets of the cartridges 301 are somewhat or completely synchronized in their motion. This synchronization may result because the free standing dividing wall 170 allows the left hand and right hand sides of the outer follower 161 and the inner follower 162 to remain connected across in front of and rearward of the dividing wall 170. Thus, both sides of the outer follower 161 and the inner follower 162 may only move together so the cartridges 301 only move in unison. The inner follower 162 cannot move out of synchronization with respect to the outer follower 161 because the weaker inner spring 152 cannot independently move the innermost columns of cartridges 301 adjacent the dividing wall 170 because outermost cartridges 301L and 301R are interlocked with the innermost columns of cartridges 310. All columns of the cartridges 301 therefore move substantially in unison. Due to the relative spring forces, the outer follower 161 and its stronger outer spring 151 lift the outer columns of the cartridges 301 such that in any instance, all of the cartridges 301 move substantially in unison.

This synchronization better facilitates merging of the two sets of the cartridges 301. One set of the cartridges 301 is offset with respect to the other set of the cartridges 301 by staggered upper surfaces 168 and 169 so as to further enhance the merging thereof. In this manner, the undesirable misfeeding or jamming of the cartridges 301 as the cartridges 301 merge may be substantially mitigated.

By substantially nesting or telescoping the outer spring 151 and the inner spring 152, the use of a shorter spring assembly (defined by the combination of outer spring 151 and inner spring 152), and consequently a shorter housing 101, is facilitated. For example, approximately twice the number of spring coils may be provided according to an embodiment (as shown in FIGS. 1-3) as would otherwise be provided in a conventional magazine of the same length.

In an embodiment, the inner spring 152 may be substantially weaker than the outer spring 151 such that the strongest force provided by the inner spring 152, such as when the inner spring 152 is compressed, is less than the weakest force provided by the outer spring 151, such as when the outer spring 151 fully expanded. In this manner, the inner spring 152 expands only after the outer spring 151 has ceased expansion, such as when the staggered upper surfaces 168 and 169 of the outer follower 161 contact the stops 121. The interlocking of the staggered double columns of cartridges 301 above the substantially nested outer follower 161 and inner follower 162 inhibits independent upward movement of the outer follower 161 and inner follower 162 prior to the outer spring 151 ceasing expansion.

Having discussed the structure of magazine 100, the operation of an embodiment thereof will now be discussed. The magazine 100 may be filled with cartridges 301 by hand, either with or without the use of a tool (e.g., such as a conventional tool for loading magazines with cartridges) or by a machine. The magazine 100 may be filled with cartridges 301 either by the provider of the magazine 100 (e.g., such as an armory, depot, or factory), in the field, or at any other desired location.

As the cartridges 301 are loaded into the magazine 100, the cartridges 301 are positioned first by staggered upper surfaces 166 and 167 of the inner follower 162 and subsequently (as more cartridges 301 are loaded) by the staggered upper surfaces 168 and 169 of the outer follower 161. The cartridges 301 are formed into staggered columns thereof. Thus, the configurations (particularly the heights) of the staggered upper surfaces 168 and 169 of the outer follower 161 and the staggered upper surfaces 166 and 167 of the inner follower 162 determine the configuration of the cartridges 301 disposed within the magazine 100.

The first one of the cartridges 301 loaded will be disposed upon the lowermost upper surface 167 of the inner follower 162 and the second one of the cartridges 301 loaded will be disposed upon the uppermost upper surface 166 of the inner follower 162 to initiate a stagger sequence of cartridges 301. Subsequently, loaded cartridges 301 will continue this staggered sequence. After the inner follower 162 has been pushed downwardly to the point where it is approximately below the taper 113, the stagger sequence will be split onto each side of the dividing wall 170

As the cartridges 301 are further loaded into the magazine 100, the cartridges 301 are guided by the dividing wall 170 into one of the two sets of the cartridges 301 which are staggered on either side of the dividing wall 170. The cartridges 301 that are biased to the left of the dividing wall 170 are guided to the left of the dividing wall 170 as the cartridges 301 contact the tip 171 of the dividing wall 170. Similarly, the cartridges 301 that are biased to the right of the dividing wall 170 are guided to the right of the dividing wall 170 as the cartridges 301 contact the tip 171 of the dividing wall 170.

The magazine 100 may be filled with the cartridges 301 so as to compress both the outer spring 151 and the inner spring 152. When the magazine 100 is completely filled with the cartridges 301, the outer spring 151 and the inner spring 152 are approximately fully compressed and the inner spring 152 is substantially nested within the outer spring 151 (as shown in FIGS. 3-5). Also when the magazine 100 is completely filled with cartridges 301, inner follower 162 and the inner spring 152 are substantially nested within the outer follower 161 and the outer follower 161 is substantially nested within the outer spring 151. Because of these various features, the compressed stack height of the two springs 151, 152 is substantially reduced so that the length of the magazine 100 need not be as long as would be needed if all of the springs were stacked atop one another as in conventional box magazines.

Nesting of the inner follower 162 at least partially within the outer follower 161 facilitates cooperation of the inner follower 162 and the outer follower 161 to define a single combined follower that moves cartridges 301 toward the top end 112 of the housing 101. Nesting of the inner follower 162 at least partially within the outer follower 161 also facilitates independent functioning of the inner follower 162 to move cartridges 301 toward the top end 112 of the housing 101 without corresponding movement of the outer follower 161.

An uppermost cartridge 301A (and consequently all of the other cartridges 301) is held in place by the lips 116. The uppermost cartridge 301A slides from the magazine 100 as the uppermost cartridge 301A is fed to the firearm.

When the firearm cycles, the uppermost cartridge 301A is fed from the magazine into the firearm's chamber. When there are cartridges 301 held within the lower region 102 of the housing 101 and the uppermost cartridge 301A is fed from the magazine 100, then the outer spring 151 expands so as to push all of the remaining ones of the cartridges 301 away from the bottom end 111 of the housing 101 and toward the top end 112 thereof so that the next uppermost cartridge 301A (e.g., the cartridge 301 following after the previously fed uppermost cartridge 301A) is again held in place by the lips 116.

As the firearm is fired, outer spring 151 continues to expand and push all of the cartridges 301 toward the top end 112 of the magazine until the staggered upper surfaces 168 and 169 of the outer follower 161 contact the outer follower stops 121. When the staggered upper surface 168 and 169 of the outer follower 161 contact the outer follower stops 121, all of the cartridges 301 from the lower region 102 of the housing 101 will have moved out of the lower region 102. Some of the cartridges 301 from the lower region 102 may remain in the upper region 103, as shown in FIG. 2.

After the staggered upper surfaces 168 and 169 of the outer follower 161 contact the outer follower stops 121 and some cartridges 301 still remain in the upper region 103, then the inner spring 152 expands so as to move the remaining cartridges 301 away from the bottom end 111 of the housing 101 and toward the top end 112 of the housing 101. The inner spring 152 continues to expand and move the cartridges 301 toward the top end 112 until the last cartridge 301 is fed to the firearm and the inner follower 162 contact the inner follower stops 122.

Figure 8:
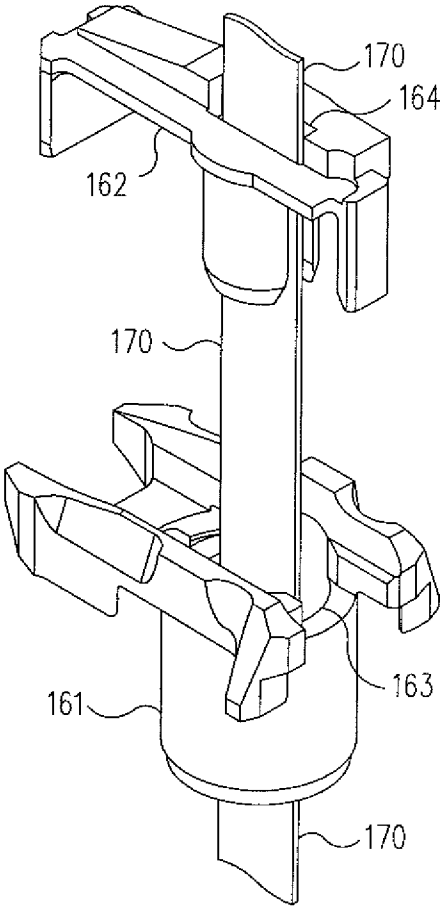
FIG. 8 is a perspective view of the inner follower, the outer follower, and a dividing wall, in accordance with an embodiment of the disclosure.
Figure 7:
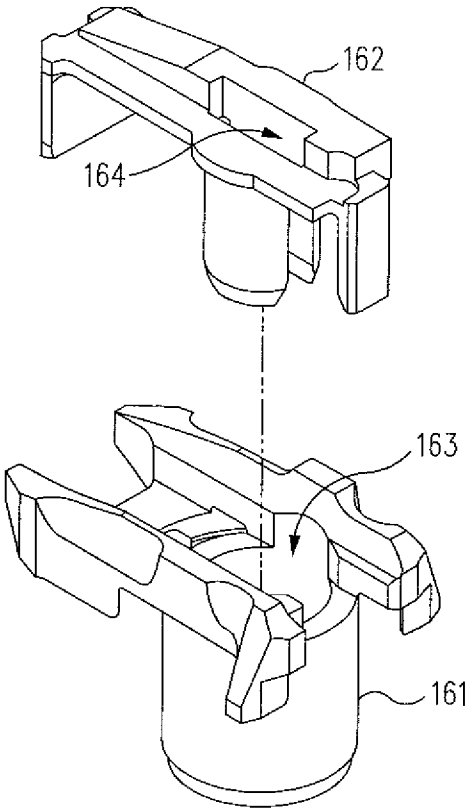
FIG. 7 is a perspective view of the inner follower and the outer follower, in accordance with an embodiment of the disclosure.
Figure 6:
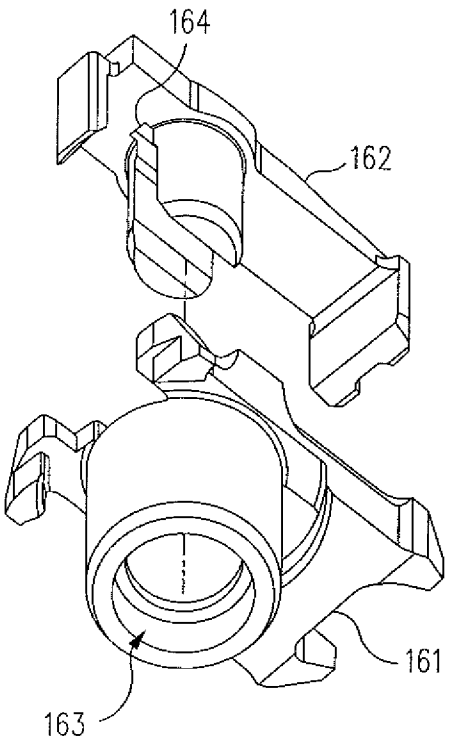
FIG. 6 is a perspective view of an inner follower and an outer follower, in accordance with an embodiment of the disclosure.

FIGS. 6-8 are perspective views showing the outer follower 161 and the inner follower 162, according to an embodiment. FIG. 8 additionally shows the dividing wall 170 extending through the opening 163 of the outer follower 161 and the opening 164 of the inner follower 162, according to an embodiment.

Other embodiments are also contemplated. For example, although the upper region 103 of the magazine is illustrated in the figures and described herein as having a staggered two column configuration, the upper region 103 may have a single column configuration in another embodiment. For example, the two columns may optionally be urged into a single column prior to the cartridges 301 reaching the top end 112 of the housing 101.

As another example, rather than implementing dividing wall 170 as a freestanding dividing wall illustrated in the figures and described herein, dividing wall 170 may be a dividing wall implemented as discussed for separating the cartridges 301 into two sets, but the dividing wall may comprise two portions. One portion of the dividing wall may be attached to the front wall 203 of the housing 101 and extend substantially therealong within the lower region 102 of the housing 101, and another portion of the dividing wall may be attached to the rear wall 202 of the housing 101 and extend substantially therealong within the lower region 102 of the housing. A gap may be formed between the two portions such that the springs and followers move within the gap in a fashion similar to that of the magazine disclosed in U.S. Pat. No. 4,589,218.

Figure 9:
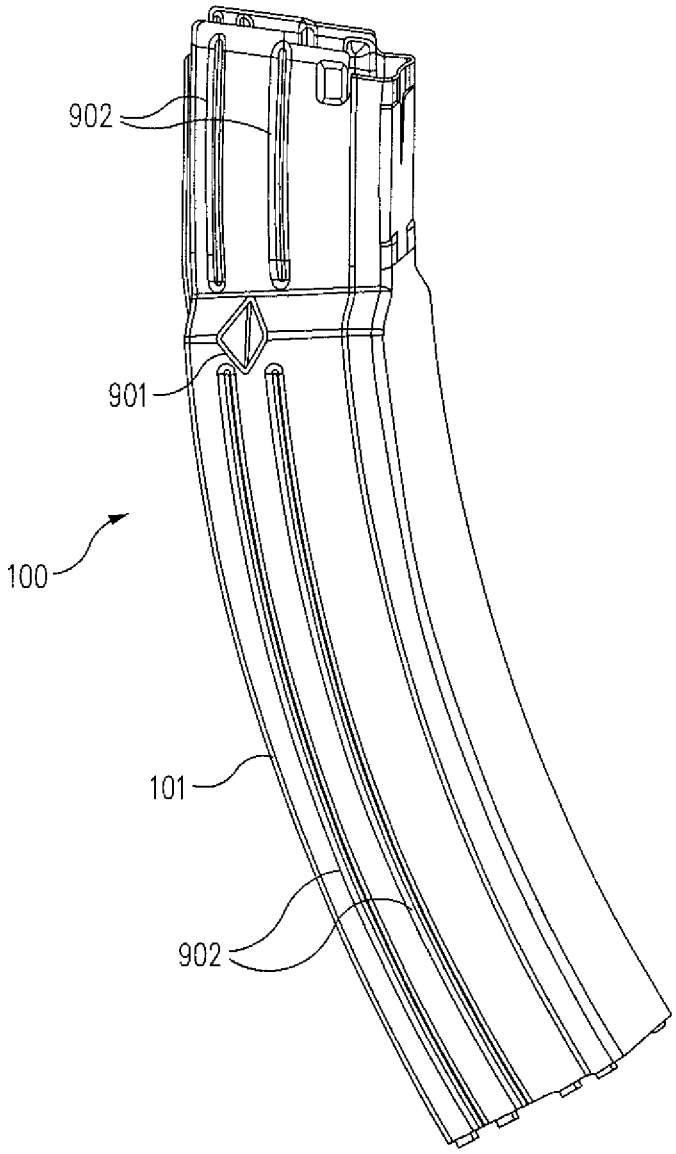
FIG. 9 is a perspective view of a housing, in accordance with an embodiment of the disclosure.

FIG. 9 is a perspective view showing the housing 101 of the magazine 100. An indentation, dimple, or groove 901 formed in the housing 101 at the tapered portion 113 may define a protrusion or rail inside of the housing 101. The rail may be considered an extension of rails formed by grooves 902 in the housing 101. All of the rails defined by grooves 901 and 902 may contact outermost ones of the cartridges 301 and maintain desired positioning of outermost one of the cartridges 301. Such rails may be formed on both sides of the housing 101.

Advantageously, high capacity magazines implemented in according with the various embodiments described herein typically require less frequent reloading than conventional lower capacity magazines and thus tend to better assure that a firearm will be ready to use when needed. Of course, having a firearm that is ready to use may save lives in many battlefield, police, and other situations.

Also, the high capacity magazine embodiments disclosed herein may provide higher capacities than conventional magazines without sacrificing reliability. In this regard, substantially stronger springs are not required, and the springs are not compressed to a point where they are likely to interfere with desired operation of the firearm. The round springs disclosed herein are less likely to take a set when the magazine remains fully loaded for an extended period of time. Thus, a high capacity magazine that is reliable, simple in construction, and comparatively inexpensive is provided.

Where applicable, the various components set forth herein may be combined into composite components and/or separated into sub-components without departing from the spirit of the present disclosure. Similarly, where applicable, the ordering of various steps described herein may be changed, combined into composite steps, and/or separated into sub-steps to provide features described herein.

Columns of the cartridges 301 may be referred to herein as having "substantially" a given width because the columns may be overlapping or staggered such that the widths are not necessarily well defined. For example, "substantially four columns of the cartridges 301" may refer to four columns of the cartridge 301 that do not overlap at all or that overlap substantially such that the columns are at least somewhat staggered.

Columns of the cartridges 301 and/or the cartridges 301 themselves may be referred to herein as being interlocked and/or staggered when there is some overlap among the columns and/or the cartridges 301. When two of the cartridges 301 in one column and one of the cartridge 301 in another column are adapted such that each of the cartridges 301 contacts the other two of the cartridges 301, then there is some overlap among the columns and the cartridges 301. Thus the columns and the cartridges 301 may be referred to as being interlocked and/or staggered.

Various embodiments, aspects, and features of the disclosure are discussed further below. Such embodiments, aspects, and features, as well as any others discussed herein, can be used separately or combined with one another, as desired.

According to an embodiment, a magazine can comprise two followers and two springs adapted to move the followers. The followers and the springs can be adapted to facilitate merging of substantially four columns of cartridges into substantially two interlocked and staggered columns of the cartridges to accelerate movement of the cartridges and mitigate force required for stripping the cartridges from the magazine.

The substantially two interlocked and staggered columns can comprise at least one of the cartridges in one column and at least two of the cartridges in another column. The two followers can be adapted to nest at least partially together. The two springs can be adapted to nest at least partially together.

The magazine can further comprise a housing and a dividing wall having a bottom and adapted to separate the cartridges into two sets of cartridges. The dividing wall can be held to the housing only at the bottom of the dividing wall.

The magazine can further comprise a housing within which the followers and the springs are substantially disposed. The housing can have a wider lower region and a narrower upper region. A dividing wall can have a bottom and can be adapted to separate the cartridges into two sets thereof in the lower region. The dividing wall can be held to the housing only at the bottom of the dividing wall. The followers can comprise an outer follower and an inner follower and the inner follower can be adapted to nest at least partially within the outer follower. The inner follower can be adapted to separate from the outer follower to enter the upper region of the housing. The springs can be adapted to at least partially nest one within the other. One spring can move the inner follower and the outer follower when the inner follower and the outer follower are in the lower region and the other spring can move the inner follower when the inner follower is in the upper region. The housing, the followers, the springs, and the dividing wall can be adapted to cooperate to merge the substantially four columns of cartridges into the substantially two interlocked and staggered columns of cartridges.

According to an embodiment, a magazine can comprise a housing adapted to facilitate merging of substantially four columns of cartridges into substantially two interlocked and staggered columns of the cartridges. This can be done to accelerate movement of the cartridges and mitigate force required for stripping the cartridges from the magazine.

The substantially two interlocked and staggered columns can comprise at least one of the cartridges in one column and at least two of the cartridges in another column. The magazine can further comprise two followers that are adapted to nest at least partially together and two springs that are adapted to nest at least partially together. The followers and the springs can be adapted to cooperate with the housing to merge four columns of cartridges into substantially two interlocked and staggered columns of the cartridges.

The magazine can comprise a dividing wall having a bottom and adapted to separate the cartridges into two sets thereof. The dividing wall can be held to the housing only at the bottom of the dividing wall.

According to an embodiment, a magazine can comprise two followers adapted to nest at least partially one within the other. The magazine can further comprise a dedicated spring for each of the followers. The magazine can further comprise a dividing wall. The followers can be adapted to receive the dividing wall therethrough.

The followers can comprise an outer follower and an inner follower adapted to at least partially nest within the outer follower. An outer spring can be adapted to move the outer follower. An inner spring can be adapted to move the inner follower. The outer follower can be adapted to cooperate with the inner follower to support substantially four columns of cartridges when the outer follower and the inner follower are nested. The inner follower can be adapted to support substantially two columns of cartridges when the outer follower and the inner follower are not nested.

The magazine can further comprise a housing within which the followers are disposed. The housing can have a first region that is adapted to hold cartridges in a substantially four across configuration and a second region that is adapted to hold cartridges in a substantially two across configuration.

The magazine can further comprise a housing within which the followers are disposed. The housing can have a first region that is adapted to hold cartridges in a substantially four across configuration, a second region that is adapted to hold cartridges in a substantially two across configuration, an outer spring, and an inner spring. The followers can comprise an outer follower and an inner follower. The outer follower can be adapted to be moved within the first region by the outer spring and can be adapted to cooperate with the inner follower to support substantially four columns of cartridges when the outer follower and the inner follower are nested. The inner follower can be adapted to be moved within the second region by the inner spring and can be adapted to support substantially two columns of cartridges when the outer follower and the inner follower are not nested. The outer follower, the inner follower, the outer spring, and the inner spring can be adapted to nest together.

According to an embodiment, a magazine can comprise two springs adapted to nest at least partially one within the other. The magazine can further comprise a dedicated follower for each of the springs. Each dedicated follower can be adapted to be moved by its associated spring.

The magazine can further comprise a dividing wall. The springs can be adapted to receive the dividing wall therethrough. The springs comprise round springs. The springs can comprise an inner spring and an outer spring that is adapted to nest at least partially within the inner spring. The outer spring can be substantially stronger than the inner spring.

According to an embodiment, a magazine can comprise a housing and a dividing wall having a bottom and adapted to separate cartridges into two sets thereof. The dividing wall can be held to the housing only at the bottom of the dividing wall.

The house can comprise a first region that is adapted to hold cartridges in a substantially four across configuration, a second region that is adapted to hold cartridges in a substantially two across configuration, and a tapered portion defining a transition between the first region the second region. The dividing wall can have an upper end proximate the tapered portion.

The magazine can further comprise a plurality of followers and a plurality of springs. The dividing wall can pass through the followers and the springs.

A magazine can comprise a housing adapted to mate to a substantially two column magazine well of a firearm and adapted to contain substantially four columns of cartridges. The housing can be adapted to mate to a magazine well of a firearm within an M4/M16 family of weapons.

According to an embodiment, a housing for a magazine can comprise a plurality of walls. The walls can be adapted to facilitate merging of substantially four columns of cartridges into substantially two interlocked and staggered columns of cartridges to accelerate movement of the cartridges and mitigate force required for stripping the cartridges from the magazine.

According to an embodiment, a outer follower for a magazine can comprise a plurality of surfaces adapted to support a plurality of cartridges and adapted to move within a magazine housing. The outer follower can be adapted to nest with an inner follower.

According to an embodiment, an inner follower for a magazine can comprise a plurality of surfaces adapted to support a plurality of cartridges and adapted to move within a magazine housing. The inner follower can be adapted to nest with an outer follower.

According to an embodiment, a follower assembly for a magazine can comprise an outer follower adapted to move within a magazine housing and an inner follower adapted to move within the magazine housing. The inner follower can be adapted to nest at least partially within the outer follower.

A magazine can comprise a first supporting means for supporting a plurality of cartridges and a second supporting means for supporting a plurality of cartridges. A first moving means can be adapted for moving the first supporting means. A second moving means can be adapted for moving the second supporting means. Means can be provided for separating cartridges into two sets. The first supporting means and the second supporting means can be adapted to nest at least partially together.

According to an embodiment, a method for advancing cartridges within a magazine can comprise merging substantially four columns of cartridges into substantially two interlocked and staggered columns of the cartridges to accelerate movement of the cartridges and mitigate force required for stripping the cartridges from the magazine. The method can comprise moving substantially four columns of cartridges within a portion of the magazine using two nested followers and moving substantially two columns of cartridges within a different portion of the magazine using an inner one of the two nested followers.

According to an embodiment, a method for advancing cartridges within a magazine can comprise nesting one follower at least partially within another follower. According to an embodiment, a method for advancing cartridges within a magazine can comprise nesting one spring at least partially within another spring.

According to an embodiment, a method for advancing cartridges within a magazine can comprise separating the cartridges in a housing into two sets thereof using a dividing wall that is held to the housing only at a bottom of the dividing wall. According to an embodiment, a method of making a magazine can comprise forming a housing that is adapted to facilitate merging of substantially four columns of cartridges into substantially two interlocked and staggered columns of cartridges to accelerate movement of the cartridges and mitigate force required for stripping the cartridges from the magazine.

According to an embodiment, a method of making a magazine can comprise putting two followers into a housing. The two followers can be adapted to nest at least partially one within the other. According to an embodiment, a method of making a magazine can comprise putting two springs into a housing. The two springs can be adapted to nest at least partially one within the other.

According to an embodiment, a method of making a magazine can comprise attaching a dividing wall within a housing only at a bottom of the dividing wall. The dividing wall can be adapted to separate cartridges within the housing into two sets thereof.

According to an embodiment, a method for using a magazine can comprise mating a magazine to a firearm. The magazine can be adapted to merge substantially four columns of cartridges into substantially two interlocked and staggered columns of cartridges to accelerate movement of the cartridges and mitigate force required for stripping the cartridges from the magazine.

According to an embodiment, a method for using a magazine can comprise mating a magazine to a firearm. The magazine can be adapted to nest one follower at least partially within another follower.

According to an embodiment, a method for using a magazine can comprise mating a magazine to a firearm. The magazine can be adapted to nest one spring at least partially within another spring.

According to an embodiment, a method for using a magazine can comprise mating a magazine to a firearm. The magazine can be adapted to separate cartridges into two sets thereof using a dividing wall that is held to a housing of the magazine only at a bottom of the dividing wall.

According to an embodiment, a magazine for providing cartridges to a firearm can comprise a housing having a top end and a bottom end substantially opposite the top end. An outer follower can be movably disposed within the housing. An inner follower can be movably disposed within the housing and can be adapted to nest at least partially within the outer follower. A first spring can be disposed within the housing and can be adapted to move the outer follower away from the bottom end of the housing. A second spring can be disposed within the housing and can be adapted to move the inner follower away from the outer follower and toward the top end of the housing, the second spring can be adapted to nest at least partially within the outer follower. The first spring and the second spring can be adapted to expand to move the cartridges to the firearm.

The spring can be disposed at least substantially between the outer follower and the bottom end of the housing. The magazine can further comprise a spring guide extending from proximate the bottom end of the housing toward the top end of the housing. The spring guide can be attached to the housing only proximate the bottom end of the housing. The spring guide can extend substantially through the first spring and the second spring.

The inner follower and the outer follower can be adapted to receive the spring guide therethrough. The spring guide can be substantially planar. The housing can comprise a tapered portion between the top end and the bottom end.

The housing can be adapted to hold the cartridges within a first region of the housing substantially between the bottom end and the tapered portion, and hold the cartridges within a second region of the housing substantially between the tapered portion and the top end, and wherein the first region exhibits a greater width than the second region. The first spring can be adapted to expand to move the cartridges from the first region to the second region using at least the first follower. The second spring can be adapted to expand to move the cartridges from the second region to the firearm through the top end of the housing using at least the second follower.

The second spring can be adapted to begin to expand only after the outer follower is proximate the tapered portion. The magazine can comprise a spring guide adapted to separate the cartridges within the first region of the housing into a first set of the cartridges on a first side of the spring guide and a second set of the cartridges on a second side of the spring guide. The first region can be adapted to hold approximately four columns of the cartridges and the second region is adapted to hold approximately two columns of the cartridges.

According to an embodiment, a method for providing cartridges to a firearm using a magazine can comprise moving cartridges away from a bottom end of a housing of a magazine and toward a top end of the housing substantially opposite the bottom end using a first spring disposed in the housing and an outer follower disposed in the housing and moving the cartridges away from the outer follower and toward the top end of the housing using a second spring disposed in the housing and an inner follower disposed in the housing. The inner follower can be adapted to nest at least partially within the outer follower. The second spring can be adapted to nest at least partially within the outer follower.

The first spring can be disposed at least substantially between the outer follower and the bottom end of the housing. The magazine can comprise a spring guide extending from proximate the bottom end of the housing toward the top end of the housing. The spring guide can be attached to the housing only proximate the bottom end of the housing. The spring guide can extend substantially through the first spring and the second spring. The inner follower and the outer follower can be adapted receive the spring guide therethrough. The spring guide can be substantially planar. The housing can comprise a tapered portion between the top end and the bottom end.

The method can further comprise holding the cartridges within a first region of the housing substantially between the bottom end and the tapered portion and holding the cartridges within a second region of the housing substantially between the tapered portion and the top end. The first region can exhibit a greater width than the second region.

Moving cartridges away from the bottom end of the housing can comprise expanding the first spring to move the cartridges from the first region to the second region using at least the first follower. Moving of the cartridges away from the outer follower can comprise expanding the second spring to move the cartridges from the second region to the firearm through the top end of the housing using at least the second follower.

Expanding of the second spring can occur only after the outer follower is proximate the tapered portion. The method can further comprise separating the cartridges within the first region of the housing into a first set of the cartridges on a first side of a spring guide and into a second set of the cartridges on a second side of the spring guide.

Holding the cartridges within the first region of the housing can comprise holding approximately four columns of the cartridges within the first region. Holding the cartridges within the second region of the housing can comprise holding approximately two columns of the cartridges in the second region.

According to an embodiment, a weapon system can comprise a firearm and a magazine for providing cartridges to the firearm. The magazine can be removably attachable to the firearm. The magazine can comprise a housing having a top end and a bottom end substantially opposite the top end, an outer follower movably disposed within the housing, an inner follower movably disposed within the housing and adapted to nest at least partially within the outer follower, a first spring disposed within the housing and adapted to move the outer follower away from the bottom end of the housing, and a second spring disposed within the housing and adapted to move the inner follower away from the outer follower and toward the top end of the housing. The second spring can be adapted to nest at least partially within the outer follower. The first spring and the second spring can be adapted to expand to move the cartridges to the firearm.

When a number of columns is referred to herein (such as when referring to the "two column region" and the "four column region"), such reference may be inferred to be with respect to "substantially" that number of columns due to the staggering and/or interlocking thereof. Thus, referring to a "two column region" or referring to a "four column region" may be the same as referring to a "substantially two column region" or referring to a "substantially four column region". That is, the terms a "two column region" and "four column region" may be used interchangeable with "substantially two column region" and "substantially four column region" and may have the same meaning.

As used herein, the term "stripping force" may refer to the force that is applied by a bolt of a firearm to a cartridge of a magazine so as to feed the cartridge from the magazine to the firearm.

Various embodiments may use various features described herein. An embodiment does not necessarily have all of the features described herein. Thus, a given embodiment may use any desired combination of such features.

Embodiments described above illustrate but do not limit the disclosure. It should also be understood that numerous modifications and variations are possible in accordance with the principles of the present disclosure. Accordingly, the scope of the invention is defined only by the following claims.

What is claimed is:

1. A magazine comprising:

two followers;

two springs adapted to move the followers; and wherein the followers and the springs are adapted to facilitate merging of substantially four columns of cartridges into substantially two interlocked and staggered columns of the cartridges to accelerate movement of the cartridges and to mitigate a force required for stripping the cartridges from the magazine;

wherein the two followers are adapted to nest at least partially together; and wherein the two springs are adapted to nest at least partially together.

2. The magazine of claim 1, wherein the substantially two interlocked and staggered columns comprise at least one of the cartridges in one column and at least one of the cartridges in another column.

3. The magazine of claim 1, further comprising a housing within which the followers and the springs are substantially disposed, the housing having a wider lower region and a narrower upper region.

4. The magazine of claim 1, further comprising:

a housing having a wider lower region and a narrower upper region;

a dividing wall having a bottom and adapted to separate the cartridges into two sets thereof in the lower region, wherein the dividing wall is held to the housing only at the bottom of the dividing wall;

wherein:

the followers comprise an outer follower and an inner follower and the inner follower is adapted to nest at least partially within the outer follower;

the inner follower is adapted to separate from the outer follower to enter the upper region of the housing;

the springs are adapted to nest at least partially one within the other; and one of the springs is adapted to move the inner follower and the outer follower when the inner follower and the outer follower are in the lower region and the other of the springs is adapted to move the inner follower when the inner follower is in the upper region.

5. The magazine of claim 1, further comprising:

a housing;

a dividing wall, wherein the two followers are adapted to receive the dividing wall therethrough; and wherein the housing, the followers, the springs, and the dividing wall are adapted to cooperate to merge the substantially four columns of cartridges into the substantially two interlocked and staggered columns of cartridges.

6. A magazine comprising:

two followers adapted to nest at least partially one within the other; and two springs are adapted to nest at least partially one within the other.

7. The magazine of claim 6, wherein the springs are round coil springs.

8. The magazine of claim 6, further comprising:

a dividing wall;

wherein the followers are adapted to receive the dividing wall therethrough; and wherein the two springs comprises a dedicated spring for each of the followers.

9. The magazine of claim 6, wherein:

a first one of the followers is an outer follower;

a second one of the followers is an inner follower;

the two springs comprise:

an outer spring adapted to move the outer follower;

an inner spring adapted to move the inner follower;

the outer follower is adapted to cooperate with the inner follower to support substantially four columns of cartridges when the outer follower and the inner follower are nested; and the inner follower is adapted to support substantially two columns of cartridges when the outer follower and the inner follower are not nested.

10. The magazine of claim 6, further comprising:

a housing within which the followers are disposed, the housing having a first region that is adapted to hold cartridges in a substantially four across configuration and a second region that is adapted to hold cartridges in a substantially two across configuration;

wherein the two springs comprises an outer spring and an inner spring;

wherein a first one of the followers is an outer follower;

wherein a second one of the followers is an inner follower;

wherein the outer follower is adapted to be moved within the first region by the outer spring and is adapted to cooperate with the inner follower to support substantially four columns of cartridges when the outer follower and the inner follower are nested; and wherein the inner follower is adapted to be moved within the second region by the inner spring and is adapted to support substantially two columns of cartridges when the outer follower and the inner follower are not nested.

11. The magazine of claim 6, further comprising a housing adapted to mate to a substantially two column magazine well of a firearm and adapted to contain substantially four columns of cartridges.

12. A method for providing cartridges to a firearm using a magazine, the method comprising:

moving cartridges away from a bottom end of a housing of a magazine and toward a top end of the housing substantially opposite the bottom end using a first spring disposed in the housing and an outer follower disposed in the housing;

moving the cartridges away from the outer follower and toward the top end of the housing a second spring disposed in the housing and an inner follower disposed in the housing;

wherein the inner follower is adapted to nest at least partially within the outer follower; and wherein the second spring is adapted to nest at least partially within the outer follower.

13. The method of claim 12, wherein:

the first spring is disposed at least substantially between the outer follower and the bottom end of the housing;

the magazine comprises a spring guide extending from proximate the bottom end of the housing toward the top end of the housing;

the spring guide is not fastened to the housing and is held to the housing only proximate the bottom end of the housing;

the spring guide extends substantially through the first spring and the second spring;

the inner follower and the outer follower are adapted receive the spring guide therethrough;

the spring guide is substantially planar; and the housing comprises a tapered portion between the top end and the bottom end.

14. The method of claim 13, further comprising:

holding the cartridges within a first region of the housing substantially between the bottom end and the tapered portion;

holding the cartridges within a second region of the housing substantially between the tapered portion and the top end; and wherein the first region exhibits a greater width than the second region.

15. The method of claim 14, wherein:

the moving the cartridges away from the bottom end of the housing comprises expanding the first spring to move the cartridges from the first region to the second region using at least the first follower; and the moving the cartridges away from the outer follower comprises expanding the second spring to move the cartridges from the second region to the firearm through the top end of the housing at least the second follower.

16. The method of claim 14, wherein the expanding the second spring occurs only after the outer follower is proximate the tapered portion.

17. The method of claim 14, further comprising separating the cartridges within the first region of the housing into a first set of the cartridges on a first side of the spring guide and into a second set of the cartridges on a second side of the spring guide.

18. The method of claim 14, wherein:

the holding the cartridges within the first region of the housing comprises holding substantially four columns of the cartridges within the first region; and the holding the cartridges within the second region of the housing comprises holding substantially two columns of the cartridges in the second region.

19. The method of claim 12, wherein the inner follower, the outer follower, the first spring, and the second spring are adapted to facilitate merging of substantially four columns of the cartridges into substantially two interlocked and staggered columns of the cartridges to accelerate movement of the cartridges and to mitigate a force required for stripping the cartridges from the magazine.

20. The method of claim 12, wherein:

a dividing wall having a bottom is adapted to separate the cartridges into two sets thereof in a lower region of the magazine; and the dividing wall is not fastened to the housing and is held to the housing only at the bottom of the dividing wall.

21. The magazine of claim 6, further comprising:

a housing, wherein the two followers and the two springs are within the housing;

a dividing wall having a bottom and adapted to separate cartridges into two sets thereof;

wherein the dividing wall is held to the housing only at the bottom of the dividing wall; and wherein the followers are adapted to receive the dividing wall thcrcthrough.

22. The magazine of claim 21, wherein the housing comprises:

a first region that is adapted to hold cartridges in a substantially four across configuration;

a second region that is adapted to hold cartridges in a substantially two across configuration;

a tapered portion defining a transition between the first region the second region; and wherein the dividing wall has an upper end proximate the tapered portion.

23. The magazine of claim 21, wherein the dividing wall passes through the followers and the springs.

24. The magazine of claim 21, wherein the housing is adapted to facilitate merging of substantially four columns of cartridges into substantially two interlocked and staggered columns of the cartridges to accelerate movement of the cartridges and to mitigate a force required for stripping the cartridges from the magazine.

25. The magazine of claim 24, wherein the substantially two interlocked and staggered columns comprise at least one of the cartridges in one column and at least one of the cartridges in another column.

26. The magazine of claim 21, further comprising:

a top end of the housing and a bottom end of the housing substantially opposite the top end;

wherein a first one of the two followers comprises an outer follower movably disposed within the housing;

wherein a second one of the two followers comprises an inner follower movably disposed within the housing and adapted to nest at least partially within the outer follower;

a first spring disposed within the housing and adapted to move the outer follower away from the bottom end of the housing;

a second spring disposed within the housing and adapted to move the inner follower away from the outer follower and toward the top end of the housing, the second spring being adapted to nest at least partially within the outer follower; and wherein the first spring and the second spring are adapted to expand to move the cartridges to a firearm.

27. The magazine of claim 26, wherein:

the housing comprises a tapered portion between the top end and the bottom end;

the housing is adapted to hold the cartridges within a first region of the housing substantially between the bottom end and the tapered portion, and hold the cartridges within a second region of the housing substantially between the tapered portion and the top end; and the first region exhibits a greater width than the second region.

28. The magazine of claim 21, wherein the dividing wall is flexible and self centering.

* * * * *